US007399381B2

(12) United States Patent
Aust et al.

(10) Patent No.: US 7,399,381 B2
(45) Date of Patent: Jul. 15, 2008

(54) MACHINE FOR PRODUCING AND TREATING A SHEET OF MATERIAL

(75) Inventors: Richard Aust, Mönchengladbach (DE); Christoph Henninger, Heidenheim (DE); Stefan Reich, Heidenheim (DE); Martin Tietz, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 508 days.

(21) Appl. No.: 11/015,437

(22) Filed: Dec. 17, 2004

(65) Prior Publication Data

US 2005/0100678 A1 May 12, 2005

Related U.S. Application Data

(63) Continuation of application No. PCT/EP2003/50208, filed on Feb. 6, 2003.

(30) Foreign Application Priority Data

Jun. 24, 2002 (DE) ..... 102 28 134

(51) Int. Cl.
*D21H 19/00* (2006.01)

(52) U.S. Cl. ..... 162/265; 162/135; 162/136; 162/137; 427/424; 118/75; 118/117; 118/DIG. 4

(58) Field of Classification Search ..... 162/135–137, 162/204–207, 265, 266, 361, 381; 427/420, 427/424, 421.1; 118/110–119, 121–123, 118/325, DIG. 4, 75; 34/329, 419, 422, 428, 34/110

See application file for complete search history.

(56) References Cited

U.S. PATENT DOCUMENTS 2,309,089 A * 1/1943 Bauer et al. ..... 162/166

(Continued)

FOREIGN PATENT DOCUMENTS

DE 19513531 4/1995

(Continued)

*Primary Examiner*—Eric Hug
(74) *Attorney, Agent, or Firm*—Taylor & Aust, P.C.

(57) ABSTRACT

A machine for producing and treating a web of material including a material web forming device, a dewatering and drying section, at least one application apparatus, a drying device and a processing device. The material web forming device forms a material web continuously from a supplied fibrous suspension. The dewatering and drying section is arranged along a material web path after the material web forming device. The section extracts water from the web by way of at least one of thermal and mechanical action. The at least one application apparatus is arranged along the material web path after the dewatering and drying section. The apparatus applies liquid or pasty application medium to at least one side of the web. The drying device is arranged along the material web path after the application apparatus. The drying device dries the moving material web to a final drying state. The processing device is arranged along the material web path after the drying device. The processing device at least one of processing, picking up and discharging the web. The at least one application apparatus includes at least one contactless application unit discharging application medium in a free application medium jet, an application medium curtain, an application medium veil or an application medium droplet spray. The at least one contactless application unit applying the application medium to the web on the basis of forces to the application medium, movement impulses imparted to the application medium and on movement of the application medium induced by the force of gravity.

13 Claims, 5 Drawing Sheets

U.S. PATENT DOCUMENTS

| | | | | |
|---|---|---|---|---|
| 5,789,031 | A * | 8/1998 | Hirabayashi et al. | 427/341 |
| 5,944,955 | A | 8/1999 | Bossen et al. | 162/198 |
| 6,254,725 | B1 * | 7/2001 | Lau et al. | 162/135 |
| 6,503,325 | B1 | 1/2003 | Hess | 118/325 |
| 6,589,388 | B1 | 7/2003 | Nissinen | 162/135 |
| 6,699,362 | B1 * | 3/2004 | Rautiainen | 162/136 |
| 6,733,630 | B1 * | 5/2004 | Rantanen et al. | 162/204 |

FOREIGN PATENT DOCUMENTS

| | | | |
|---|---|---|---|
| DE | 19735588 | | 8/1997 |
| DE | 19954083 | | 11/1999 |
| DE | 10012256 | | 3/2000 |
| EP | 1036880 | | 9/2000 |
| WO | WO 00/55424 | * | 9/2000 |

* cited by examiner

MACHINE FOR PRODUCING AND TREATING A SHEET OF MATERIAL

CROSS REFERENCE TO RELATED APPLICATIONS

This is a continuation of PCT application No. PCT/EP2003/050208, entitled "MACHINE FOR THE PRODUCING AND TREATING A SHEET OF MATERIAL, COMPRISING AN APPLICATION DEVICE THAT IS PROVIDED WITH AT LEAST ONE CONTACTLESS APPLICATION UNIT", filed Jun. 2, 2003.

BACKGROUND OF THE INVENTION

1. Field of the Invention

The present invention relates to a machine for producing and treating a sheet of web material, and more particularly to a material web forming device, which forms a material web continuously from a supplied raw material.

2. Description of the Related Art

Conventionally, machines which permit the production and treatment of the material web, include the application of an application medium to at least one side, in what is known as an online operation, where only contact application apparatuses, in the form of coating units, are used as the application apparatus. Contactless application apparatuses, such as contactless coating units, are conventionally used only in what is known as an offline operation within a coating or application machine, which is separated from the machine for producing the material web, to which the material web, to be treated, is supplied in the form of material web reels.

Contact application apparatuses can be a problem inasmuch as the performance and average operating time between operating interruptions can be impaired as a result of the contact application or coating. For example, there is an increased risk of a web break at the application unit, resulting in the entire production line coming to a standstill.

As compared with an online operation, relative to the coating of the material web, an offline operation has a lower volumetric efficiency.

What is needed in the art is an apparatus to improve the performance or runnability of the machine without having to accept the volume losses of the offline concept.

SUMMARY OF THE INVENTION

The present invention is a machine having an application device with at least one contactless application unit. The unit is designed to discharge application medium in at least one free application medium jet or application medium curtain or application medium veil or application medium droplet spray and to apply it to the material web on the basis of the forces and/or movement impulses imparted to the application medium and/or on the basis of a movement of the application medium induced by the force of gravity. In addition to an application on the basis of the force of gravity, an application on the basis of electrostatic forces, is also contemplated.

According to one embodiment of the present invention, a contactless application of the application medium, to at least one side of the material web, in particular, a contactless coating of one or both sides of the material web in an online operation in the machine, in particular a papermaking machine, is made possible. To a certain extent, the advantages of the conventional contact coating in an online operation and the conventional contactless coating in an offline operation are obtained in combination, specifically the higher volumetric efficiency of the online operation and the improved runnability of the contactless non-contact coating conventionally used only in offline operation.

Use is made of what is called a curtain application method or curtain coating. For this purpose, at least one contactless application unit, designed as a curtain application unit is provided, which discharges the application medium in the form of at least one curtain or veil onto the material web. The basis of the movement of the application medium is predominantly induced by the force of gravity. Alternatively, use can also be made of what is known as a spray application method or spray coating. At least one contactless application unit is a spray application unit, which discharges the application medium in the form of an application medium droplet spray or application medium jets onto the material web. The application being at least predominantly on the basis of movement of impulses imparted to the application medium as it emerges from a nozzle arrangement of the application unit.

The curtain application method is preferred as compared with the spray application method, since on the basis of the curtain application method, a higher product quality can be achieved, and the curtain application method generally entails less effort directed to maintenance than the spray application method.

The machine, according to one embodiment of the present invention, can have at least one further material web treatment device. Such a further material web treatment device can be arranged along the material web path between the material web forming device and the dewatering and drying section; or between the dewatering and drying section and the application apparatus; or between the application apparatus and the drying device; or between the drying device and the device for processing and/or picking up and/or discharging the material web; or integrated into the material web forming device; or the dewatering and drying section; or the application apparatus; or the drying device; or the device for processing and/or picking up and/or discharging the material web.

The further material web treatment device is preferably at least one material web smoothing device. The material web smoothing device may be arranged along the material web path before the application apparatus. The material web smoothing device is preferably arranged between the dewatering and drying section and the application apparatus or integrated into the dewatering and drying section.

Connecting the material web smoothing upstream of the application of the application medium is expedient and effective inasmuch as the contactless application methods, in particular coating methods, largely maintain the contour of the material web surface (in this connection, one speaks of "contour coating methods"). This means that a rough contour of the material web is not evened out or smoothed, or only comparatively little, by the application medium. The smoother the material web was before the application of the application medium, the higher is the achieved product quality. In this connection, it has been shown that it is better to smooth first and then to apply the contour coating than to smooth a rough contour after the coating.

It has proven to be beneficial if the material web smoothing device is designed to smooth the material web, at least on one side, in such a way that a material web roughness of no more than 5 μm, and preferably at most 3 μm, remains. These material web roughness values preferably relate to values determined by way of the PPS method (Parker PrintSurf): roughness (PPS-10 s)≦5 μm, better≦3 μm.

With regard to the material web smoothing device or the material web roughness achieved by the latter, these roughness values are achieved on the basis of normal operating parameters of the machine.

A material web smoothing device is provided along the material web path after the application apparatus. This applies in principle irrespective of whether a material web smoothing device is provided before the application apparatus or not.

The material web smoothing device can advantageously have a smoothing unit from the group consisting of: a soft nip calender, a wide nip calender, a hard nip calender, a supercalender, a multi-nip smoothing unit (e.g. Janus), a 1-nip calender, and a 2-nip calender.

It should further be mentioned that the contactless application by way of an appropriate application device is also advantageous, in particular when application medium is applied to the moving material web at a plurality of application points in the machine. The material web is stressed less by the contactless application of the application medium than by a contact application, so that the risk of web breaks is reduced, and, accordingly, the performance and/or runnability is improved.

Another emobodiement of the present invention further relates to the use of a contactless application unit, in particular a curtain application unit or spray application unit, to apply a liquid or pasty application medium to a moving material web, preferably of paper or board. According to the present invention, the contactless application unit is used to apply a liquid or pasty application medium to a moving material web, preferably of paper or board, in an online process within a machine for producing or treating the material web.

In relation to the contactless application of application medium, in particular the contactless coating, thought is primarily given to an application of the application medium such that first, the application is carried out without contact and second, no metering and preferably no equalization of the application medium applied, by way of a doctor device or the like, is required. The application of the application medium is preferably therefore carried out both with the correct metering and with adequate uniformity over the surface of the material web. This means that the application to the material web is not carried out in excess, what is known as a 1-to-1 application.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
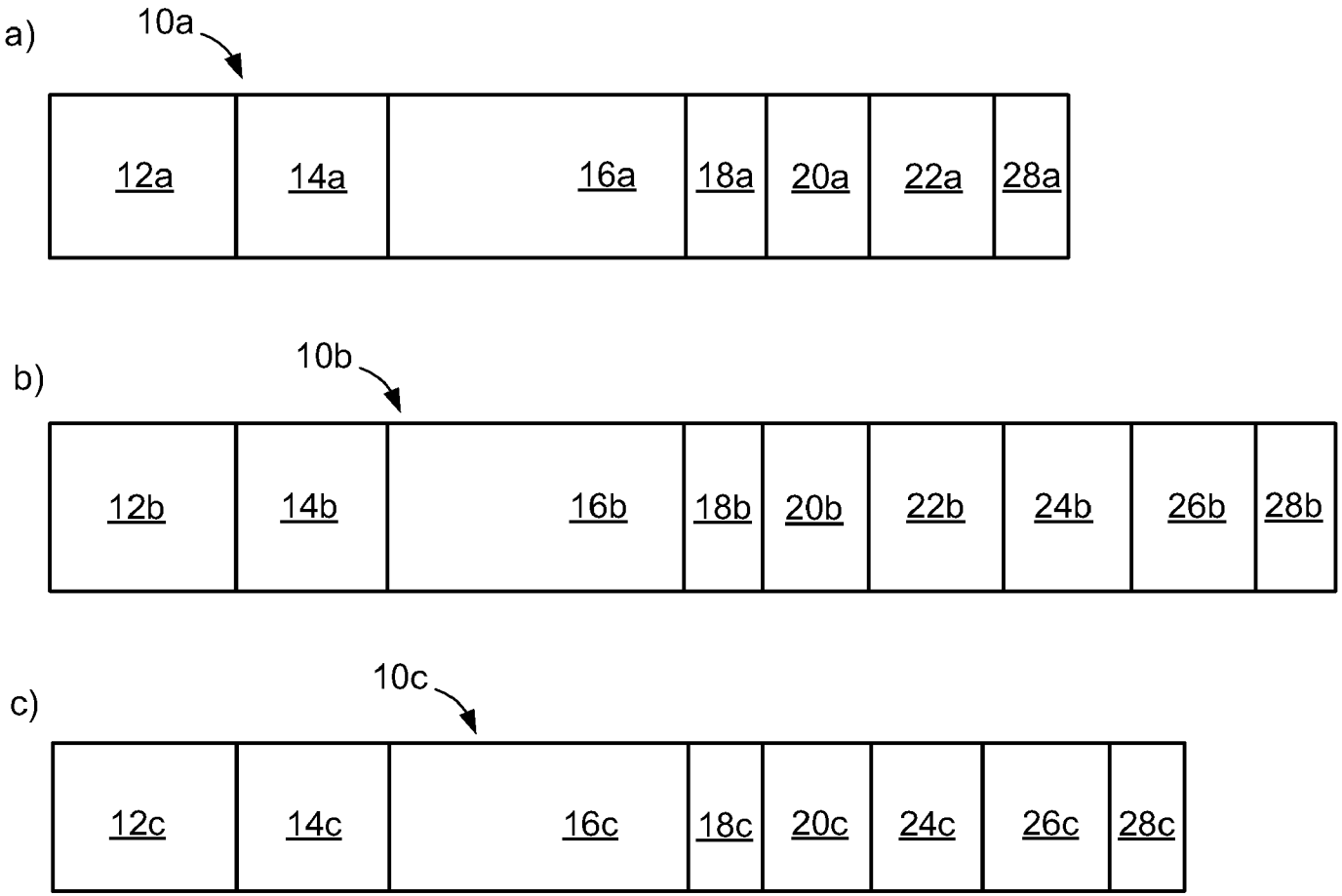
FIG. 1 shows in schematic form three examples of possible configurations of a machine according to the present invention for producing and treating a material web of paper or board.

Referring now to the drawings, and more particularly to FIGS. 1*a*, 1*b* and 1*c*, each show an example of a papermaking machine according to the present invention in a very schematic form. This can be, for example, a Fourdrinier papermaking machine or the like. Papermaking machine 10*a*, 10*b* or 10*c* has a wet end 12*a*, 12*b* or 12*c* with associated flow boxes and associated stock supply systems. The stock supply system is designed to supply a fibrous suspension to the flow box with a constant volume flow. The flow box and the wet end are used for web formation by way of uniform fiber distribution and dewatering, as well as for web guidance. Along a material web path, beginning in section 12*a*, 12*b* or 12*c*, followed by a press section 14*a*, 14*b* or 14*c*, which is used to ensure mechanical dewatering of the material web by of pressing the same.

Along the material web path, the press section is followed by a drying section 16*a*, 16*b* or 16*c*, in which the material web is dried in a thermal manner.

According to the examples of FIG. 1, after the drying section, there is arranged a material web smoothing device 18*a*, 18*b* or 18*c*, for example, what is known as a calender (for example, a soft nip calender or wide nip calender) or a smoothing unit of another suitable type.

In each of the embodiments, along the material web path, after the smoothing unit, a contactless coating unit 20*a*, 20*b* or 20*c* is arranged, such as an application apparatus. The application apparatus is a curtain application unit, which applies application medium, in particular a coating medium, to one side of the material web in a contactless manner. In the case of the curtain application unit, this is accomplished, at least predominantly on the basis of a movement induced by the force of gravity of the application medium emerging from a slot nozzle or the like in what is known as a curtain or veil. The application takes place either to that side of the material web, which can be identified as the top side, at least over the major part of the entire material web path; or to that side of the material web, which can be identified as the underside of the material web, at least over the major part of the entire material web path, but may possibly be oriented upward in some regions in the area of the application unit.

Application unit or coating unit 20*a* or 20*b* is followed by a final drying section 22*a* or an intermediate drying section 22*b*, while coating unit 20*c* is followed by a further coating unit 24*c*, which applies medium to the other side of the material web and which, just like coating unit 20*c*, applies coating medium to the material web in a contactless manner. According to the example of FIG. 1*b*, a further coating unit 24*b* is arranged after intermediate drying section 22*b*.

Along the material web path, coating unit 24*b* or 24*c* is followed by a final drying section 26*b* or 26*c* and, at the end of the material web path, there is, in all three examples, a material web reel-up 28*a*, 28*b* or 28*c*, which is used to reel up the material web coated on one or both sides on what are known as spools.

Figure 2:
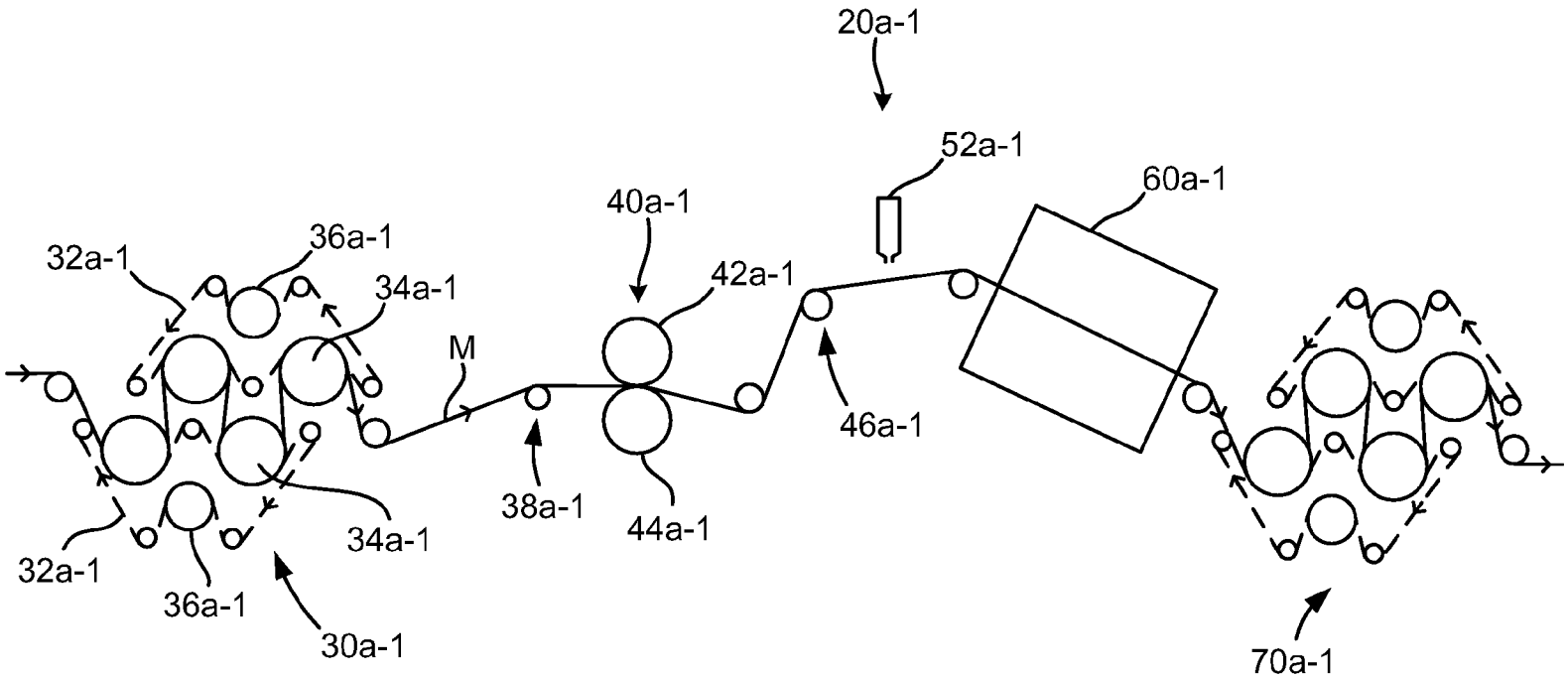
FIG. 2 represents a section of a machine corresponding to FIG. 1*a* according to a first embodiment of the implementation of a machine according to the invention having an application apparatus permitting the contactless application of application medium, specifically to an upper side of the material web.

Now, additionally referring to FIG. 2, there is shown a first example of an implementation of machine 10*a* according to FIG. 1. A drying device 30*a*-1 of drying section 16*a* is used for the thermal drying of material web M by way of circulating belts 32*a*-1. Belts 32*a*-1 press material web M against heatable drying cylinders 34*a*-1, on which material web M is subjected to what is known as contact drying. In each case a drying cylinder 36*a*-1, used for drying the felt, is assigned to felts 32*a*-1.

Material web M emerges from drying device 30*a*-1, is led over a guide roller arrangement 38*a*-1, and through a smoothing unit 40*a*-1 belonging to material web smoothing device 18*a*, which is represented by calender rolls 42*a*-1 and 44*a*-1 acting on both sides of material web M. This can be, for example, what is known as a soft nip smoothing unit or a wide nip smoothing unit.

Material web M is led over a further guide roll arrangement 46*a*-1 and through an application apparatus 20*a*-1, which has a curtain application unit that is represented by a discharge head 52*a*-1. Discharge head 52*a*-1 discharges application medium in a metered manner in the form of an application medium veil or application medium curtain. In the embodiment shown, the medium strikes the top side of material web M on the basis of the movement of the force of gravity and remains on this side of material web M without further metering and equalization, in order to provide the desired application or coating. Discharge head 52*a*-1 can advantageously be assigned edge guiding elements, or the like, for the curtain or the veil, as known from the prior art for example, German Patents DE 100 12 256 A1, DE 197 35 588 A1 and DE 195 13 531 A1.

Material web M, which has been coated with the application medium, then enters a convection or hot air dryer 60*a*-1, which is as an example of a contactless drying device, in which material web M and the application medium applied thereto is dried. The drying is to such an extent that subsequently, by way of a further drying device 70*a*-1 of the type of drying device 30*a*-1, contact drying of material web M can be carried out without quality penalties. Drying device 70*a*-1, together with dryer 60*a*-1, belong to final drying section 23*a*.

As can be seen from FIG. 1*a*, final drying section 22*a* is followed by material web reel-up 28*a*. However, still further material web treatment devices could be connected upstream of material web reel-up 28*a*, for example, a further smoothing unit.

Figure 3:
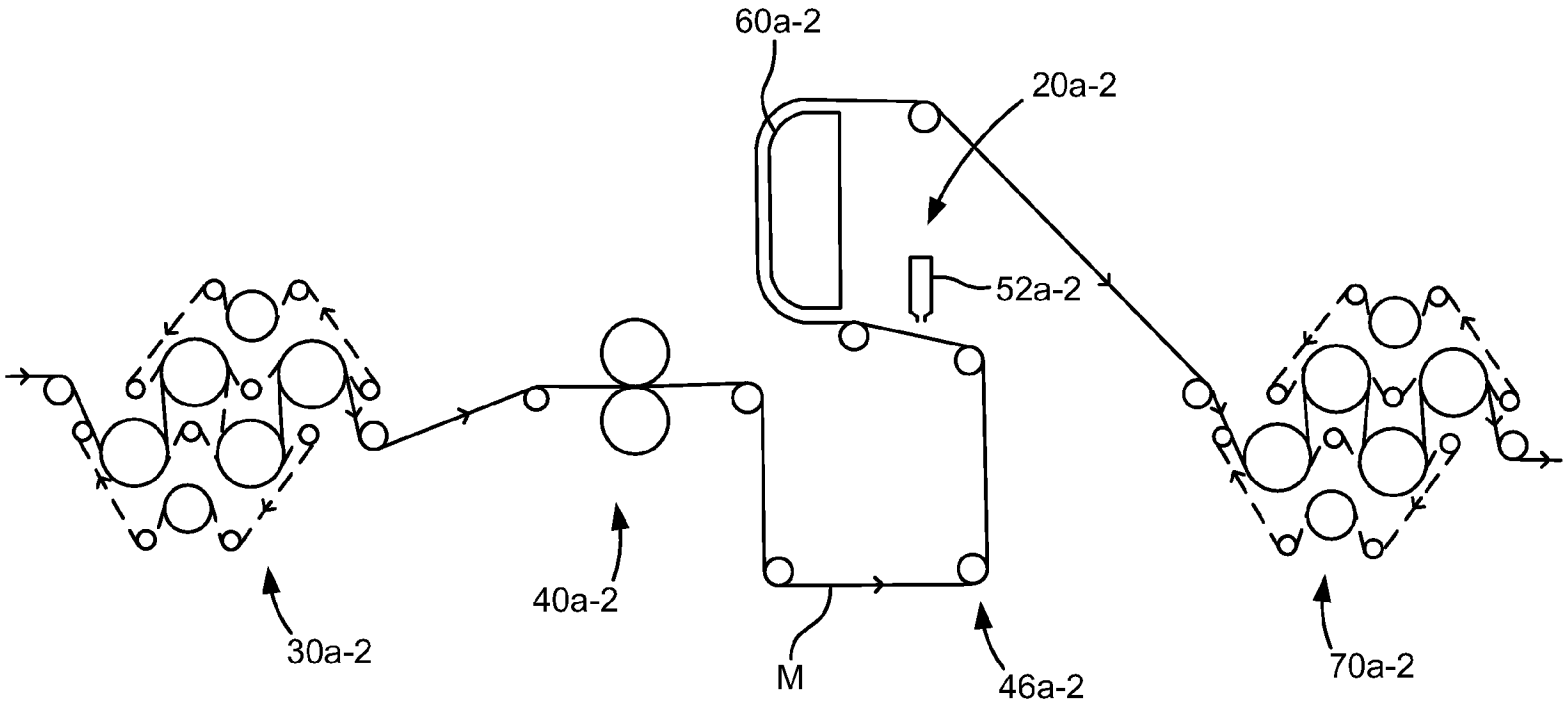
FIG. 3 represents a section of a machine corresponding to FIG. 1*a* according to another embodiment of the implementation of a machine according to the present invention having an application apparatus permitting the contactless application of application medium, specifically to an upper side of the material web.

A further embodiment of machine 10*a*, according to FIG. 1*a* is shown in FIG. 3. Machine 10*a* includes a drying device 30*a*-2 of the type of drying device 30*a*-1 according to FIG. 2, a smoothing unit 40*a*-2 corresponding to smoothing unit 40*a*-1 according to FIG. 2, and an application apparatus 20*a*-2 whose curtain application unit is again represented by a discharge head, which is designated 52*a*-2 in FIG. 3. Material web M is guided over a guide roll arrangement 46*a*-2 in such a way that, as compared with the embodiment of FIG. 2, the other material web side is provided with an application of medium without contact. Again, discharge head 52*a*-2 can be assigned edge guiding elements, and the like, for the curtain or veil of application medium.

A contactless drying device 60*a*-2 which, in addition to a contactless drying function on the basis of hot air, additionally fulfils a contactless guiding and deflection function in relation to material web M. The deflection is carried out in a manner similar to what is known as an air turn. Material web M is then fed to further drying device 70*a*-2 of the type of drying device 30*a*-1 according to FIG. 2 which, together with drying device 60*a*-2, is included in final drying section 22*a*.

Figure 4:
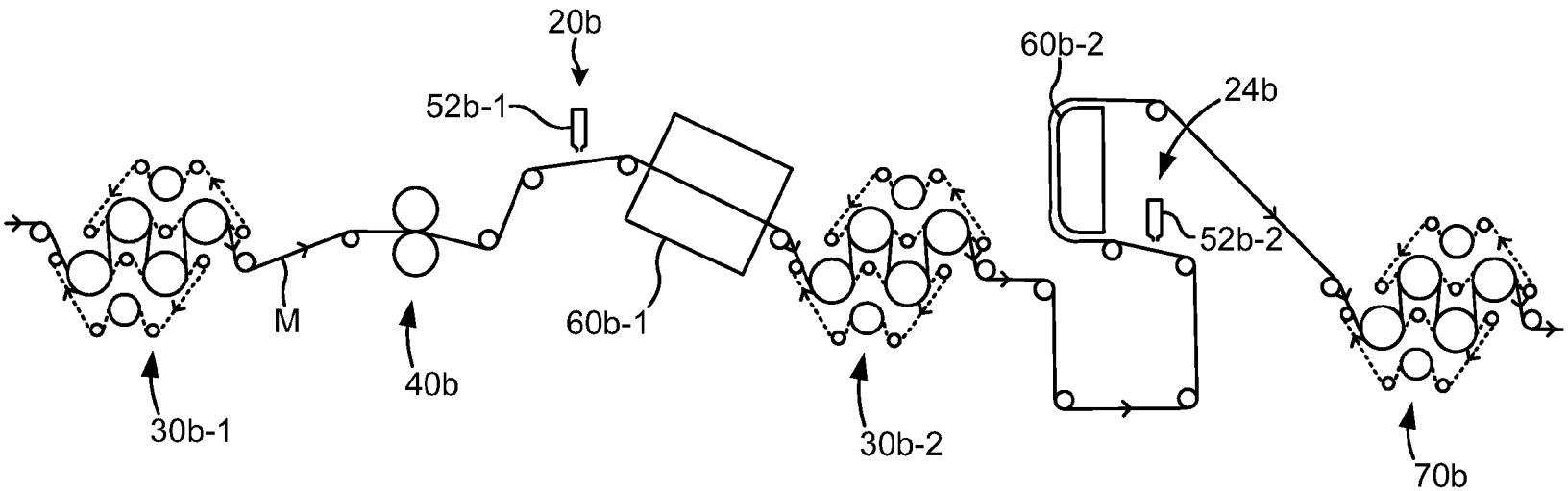
FIG. 4 represents a section of a machine corresponding to FIG. 1*b* according to another embodiment of the implementation of a machine according to the present invention having application apparatuses permitting the contactless application of application medium, specifically to both sides of the material web.

A configuration corresponding to FIG. 1*b* can be obtained, for example, by a machine section corresponding to FIG. 2 and a machine section corresponding to FIG. 3 being arranged one after another in a machine. FIG. 4 shows a corresponding example. In the material web running direction, it is possible to see one after another a drying device 30*b*-1, a smoothing unit 40*b*, an application apparatus 20*b* having a curtain application unit represented by a discharge head 52*b*-1, a contactless dryer 60*b*-1, a further contact drying device 30*b*-2, an application apparatus 24*b* having a curtain application unit represented by a discharge head 52*b*-2, a contactless drying and guide or deflection device 60*b*-2 and a further contact drying device 70*b*. Dryer 60*b*-1 and drying device 30*b*-2 form intermediate drying section 22*b* according to FIG. 1*b*.

Figure 5:
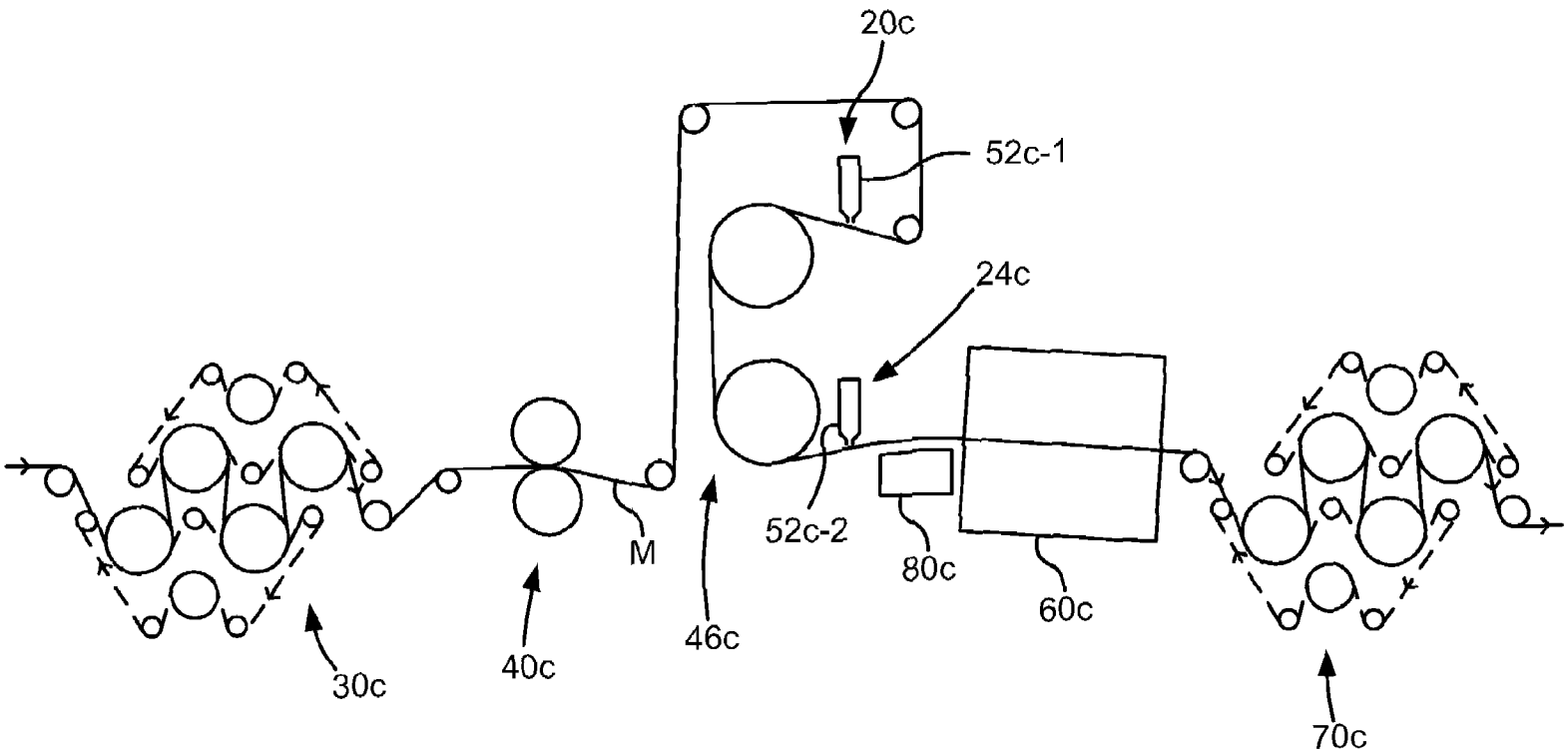
FIG. 5 represents a section of a machine corresponding to FIG. 1*c* according to yet another embodiment of the implementation of a machine according to the present invention having application apparatuses permitting the contactless application of application medium, specifically to both sides of the material web.

If an application of application medium to both sides of material web M is desired, then, given appropriate guidance of material web M, the application medium is first applied to both sides of the material web by way of a corresponding contactless application unit before contactless drying and then, finally, contact drying is carried out. It is therefore not absolutely necessary to provide intermediate drying between the application of the application medium to one side of material web M and the application of the application medium to the other side of material web M. FIG. 5 shows a corresponding example, which corresponds to an implementation of a machine of the configuration according to FIG. 1*c*. The machine includes a contact drying device 30*c*, corresponding to device 30*a*-1, a smoothing unit 40*c*, a first curtain discharge head 52*c*-1 belonging to a first contactless application apparatus 20*c*, a second discharge head 52*c*-2 belonging to a second contactless application apparatus 24*c*, a contactless dryer 60*c* and a further contact drying device 70*c* corresponding to device 30*a*-1 according to FIG. 2. From smoothing unit 40*c*, material web M is led over a guide roll arrangement 46*c*. First web M is led under first discharge head 52*c*-1 and then under second discharge head 52*c*-2, in such a way that first discharge head 52*c*-1 applies the application medium to one side of material web M and second discharge head 60*c*-2 applies the application medium to the other side of material web M in a metered manner in the form of a curtain or veil and without requiring subsequent equalization. After second discharge head 50*c*-2, an air guide arrangement 80*c* is provided, which ensures guidance of material web M with no contact on either side into dryer 60*c* and through the latter as far as the entry into contact drying device 70*c*.

Inter alia, it is proposed, in a machine for producing and treating a material web, preferably of paper or board, to provide at least one application device having at least one contactless application unit, which permits the application of a liquid or pasty application medium to at least one side of the moving material web in a contactless manner in an online process.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF DESIGNATIONS

10*a*, 10*b*, 10*c* Papermaking machine
12*a*, 12*b*, 12*c* Wet end
14*a*, 14*b*, 14*c* Press section
16*a*, 16*b*, 16*c* Drying section
18*a*, 18*b*, 18*c* Material web smoothing device
20*a*, 20*b*, 20*c*,
20*a*-1, 20*a*-2 Application apparatus or coating unit
22*a* Final drying section
22*b* Intermediate drying section
24*b*, 24*c* Application apparatus or coating unit
26*b*, 26*c* Final drying section
28*a*, 28*b*, 28*c* Material web reel-up
30*a*-1, 30*a*-2,
30*b*-1, 30*b*-2,
30*c* Drying device
32*a*-1 Felt
34*a*-1, 36*a*-1 Drying cylinder
38*a*-1 Guide roller arrangement
40*a*-1, 40*a*-2,
40*b*, 40*c* Smoothing unit.
42*a*-1, 44*a*-1 Smoothing roll
46*a*-1, 46*a*-2,
46*c* Guide roller arrangement
52*a*-1, 52*a*-2,
52*b*-1, 52*b*-2,
52*c*-1, 52*c*-2, Curtain discharge head
60*a*-1, 60*a*-2,
60*b*-1, 60*b*-2,
60*c* Drying device (contactless)
70*a*-1, 70*a*-2,
70*b*, 70*c* Drying device
80*c* Air guide device
M Material web

What is claimed is:

1. A machine for producing and treating a fiber web, comprising:

a material web forming device forming a material web continuously from a supplied fibrous suspension;

a dewatering and drying section arranged along a material web path after said material web forming device, said dewatering and drying section extracting water from the web by way of at least one of thermal and mechanical action, said dewatering and drying section drying the web at least down to a residual moisture content;

at least one application apparatus arranged along said material web path after said dewatering and drying section, said application apparatus applying one of a liquid and a pasty application medium to both sides of the web, said at least one application apparatus including a first contactless application unit and a second contactless application unit each discharging said application medium in at least one of an application medium curtain and an application medium veil, said at least one contactless application unit applying said application medium to said material web on the basis of at least one of forces imparted to said application medium, movement impulses imparted to said application medium and movement of said application medium induced by the force of gravity;

a drying device arranged along said material web path after said application apparatus, said drying device drying the moving material web to a final drying state;

a processing device arranged along said material web path after said drying device, said processing device at least one of processing, picking up and discharging the web;

an air guide arrangement following said second contactless application unit; and a contactless dryer arrangement following said air guide arrangement, the web not being contacted with anything but air from said second contactless application unit through said contactless dryer arrangement.

2. The machine of claim 1, wherein said at least one contactless application unit is a curtain application unit which discharges said application medium in the form of at least one of a curtain and veil onto the web.

3. The machine of claim 2, wherein said application medium moves at least predominantly on the basis of an induced force of gravity.

4. The machine of claim 1, further comprises at least one further material web treatment device arranged along said material web path one of between said material web forming device and said dewatering and drying section, between said dewatering and drying section and said application apparatus, between said application apparatus and said drying device, between said drying device and said processing device and integrated into one of said material web forming device, said dewatering and drying section, said application apparatus, said drying device and said processing device.

5. The machine of claim 4, wherein said further material web treatment device is at least one material web smoothing device.

6. The machine of claim 5, wherein along said the material web path before said application apparatus, a material web smoothing device is one of arranged between said dewatering and drying section and said application apparatus, and integrated into said dewatering and drying section.

7. The machine of claim 6, wherein said material web smoothing device smoothes the web on at least one side, in such a way that a material web roughness no greater than 5 μm when measured in accordance with the PPS-10 s measuring method.

8. The machine of claim 5, wherein said roughness is no greater than 3 μm.

9. The machine of claim 7, wherein said material web smoothing device achieves said material web roughness of at most 5 μm, on the basis of normal operating parameters of the machine.

10. The machine of claim 9, wherein said material web roughness is at most 3 μm.

11. The machine of claim 5, wherein said material web smoothing device is arranged along said material web path after said application apparatus.

12. The machine of claim 5, wherein said material web smoothing device includes at least one smoothing unit from the group consisting of: a soft nip calender, a wide nip calender, a hard nip calender, a supercalender, a multi-nip smoothing unit, a 1-nip calendar and a 2-nip calender.

13. A method of coating a material web, comprising the step of: using a contactless application unit that includes a first curtain application unit, and a second curtain application unit to apply one of a liquid and a pasty application medium to the moving material web in an online process within a machine for producing and treating the material web, the material web having a first side and a second side, said first curtain application unit applying said application medium to said first side, said second curtain application unit applying said application medium to said second side, conveying the web in a contactless manner after said second curtain application unit through a contactless dryer.

* * * * *